US007503458B2

(12) United States Patent
Kim et al.

(10) Patent No.: US 7,503,458 B2
(45) Date of Patent: Mar. 17, 2009

(54) CYCLONE, APPARATUS FOR SEPARATING SLURRY HAVING THE CYCLONE, AND SYSTEM AND METHOD OF SUPPLYING SLURRY USING THE APPARATUS

(75) Inventors: Seung-Un Kim, Gyeonggi-do (KR); Sa-Mun Hong, Gyeonggi-do (KR); Wang-Keun Kim, Gyeonggi-do (KR); Sang-Gon Lee, Gyeonggi-do (KR); Sang-Yeoul Hwang, Gyeonggi-do (KR)

(73) Assignees: Samsung Electronics Co., Ltd., Suwon-si, Gyeonggido (KR); C&H HI TECH CO., Ltd., Wongok-Myeon Anseong-Si, Gyeonggi-do (KR)

( * ) Notice: Subject to any disclaimer, the term of this patent is extended or adjusted under 35 U.S.C. 154(b) by 279 days.

(21) Appl. No.: 11/344,774

(22) Filed: Jan. 31, 2006

(65) Prior Publication Data

US 2006/0175234 A1 Aug. 10, 2006

(30) Foreign Application Priority Data

Feb. 4, 2005 (KR) ..... 10-2005-0010433

(51) Int. Cl.
*B04C 5/24* (2006.01)
*B04C 5/13* (2006.01)

(52) U.S. Cl. ..... 209/711; 209/721; 209/725; 209/727

(58) Field of Classification Search ..... 209/711, 209/717, 720, 721, 725, 727, 732–734; 210/512.1
See application file for complete search history.

(56) References Cited

U.S. PATENT DOCUMENTS 3,543,931 A * 12/1970 Rastatter ..... 209/728

(Continued)

FOREIGN PATENT DOCUMENTS

JP 2001-198826 7/2001

(Continued)

OTHER PUBLICATIONS

English language abstract of Korean Publication No. 2003-0092596.

(Continued)

*Primary Examiner*—Patrick H Mackey
*Assistant Examiner*—Terrell H Matthews
(74) *Attorney, Agent, or Firm*—Marger Johnson & McCollom, P.C.

(57) ABSTRACT

A cyclone used in a separator apparatus includes a body and a vortex finder. The body includes an inlet passageway, a cylindrical passageway connected to the inlet passageway, and a conical passageway connected to the cylindrical passageway. The cylindrical passageway has an upper end through which first particles in a fluid are exhausted, and a lower end. The conical passageway has an upper end connected to the lower end of the cylindrical passageway, and an opened lower end through which second particles having a specific gravity greater than that of the first particle are exhausted. The vortex finder is connected to the upper end of the cylindrical passageway. A first exhaust passageway is vertically formed in the vortex finder so that the first particles spirally ascend through the first exhaust passageway from the cylindrical passageway.

9 Claims, 12 Drawing Sheets

U.S. PATENT DOCUMENTS

| | | | | |
|---|---|---|---|---|
| 4,210,430 | A * | 7/1980 | Galow et al. | 55/344 |
| 4,354,552 | A * | 10/1982 | Zingg | 166/90.1 |
| 4,688,650 | A * | 8/1987 | Hayatdavoudi et al. | 175/324 |
| 4,983,283 | A * | 1/1991 | Grey | 210/104 |
| 5,071,557 | A * | 12/1991 | Schubert et al. | 210/512.2 |
| 5,478,484 | A * | 12/1995 | Michaluk | 210/788 |
| 6,024,874 | A * | 2/2000 | Lott | 210/512.1 |
| 6,811,713 | B2 * | 11/2004 | Arnaud | 210/788 |
| 2002/0003107 | A1 * | 1/2002 | Kampfer | 210/512.1 |
| 2003/0108674 | A1 | 6/2003 | Chung et al. | |
| 2004/0017280 | A1 | 1/2004 | Yamamoto et al. | |
| 2006/0249439 | A1 * | 11/2006 | Garner et al. | 210/202 |

FOREIGN PATENT DOCUMENTS

| | | |
|---|---|---|
| JP | 2001-287163 | 10/2001 |
| KR | 2003-0092596 | 12/2003 |

OTHER PUBLICATIONS

English language abstract of Japanese Publication No. 2001-198826.
English language abstract of Japanese Publication No. 2001-287163.

* cited by examiner

CYCLONE, APPARATUS FOR SEPARATING SLURRY HAVING THE CYCLONE, AND SYSTEM AND METHOD OF SUPPLYING SLURRY USING THE APPARATUS

CROSS REFERENCE TO RELATED APPLICATION

This application claims priority under 35 U.S.C. § 119 to Korean Patent Application No. 2005-10433, filed on Feb. 4, 2005, the contents of which are herein incorporated by reference in its entirety for all purposes.

BACKGROUND OF THE INVENTION

1. Field of the Invention

The present invention relates to a cyclone, an apparatus for separating slurry having the cyclone, and a system and a method of supplying slurry using the apparatus. More particularly, the present invention relates to a cyclone for rotating slurry, an apparatus for separating the slurry by sizes using the cyclone, and a system and a method of supplying the separated slurry to a polishing apparatus using the apparatus.

2. Description of the Related Art

Modern semiconductor devices are typically formed of multiple layers of wiring structures formed by sandwiched conductive and insulation layers that have been etched to make the desire circuit patterns. Planarization is an important component of this process. Examples of planarization processes used include an etch-back process, a reflow process, a chemical mechanical polishing (CMP) process, etc.

The CMP process was originally developed by IBM Corporation in U.S. in late 1980s. In a typical CMP process, a slurry including deionized water, an abrasive, an additive, etc., is provided between a polishing pad and the semiconductor substrate. The semiconductor substrate and the polishing pad are then rotated in reverse directions to polish a surface of the semiconductor substrate. That is, a plurality of minute surface projections of the abrasive and the polishing pad is rubbed against the surface of the semiconductor substrate to mechanically polish the surface of the semiconductor substrate. Simultaneously, chemical components in the slurry are chemically reacted with the surface of the semiconductor substrate to chemically polish the surface of the semiconductor substrate.

The efficacy of the polishing process is due in great part to the composition of the slurry used. A main drawback to using such slurries is that particle size changes over time due to agglomeration mechanisms between micro-particles within the slurry. The result is the unwanted formation of macro-particles by chemical bonding of resulting hydrophobic siloxane groups.

To address the macro-particle formation problem, such particles are precipitated out of the slurry before use and scrapped. This is generally wasteful of the expensive slurry material and increases the cost for manufacturing a semiconductor device.

Alternate methods have been proposed for providing the slurry without the macro-particles. In one such system, a separator within the reproducing unit separates the slurry by sizes. A supersonic pulverizer then pulverizes particles having a size larger than a predetermined size and the pulverized particles again separated. A mixing unit then mixes the separated slurry and deionized water and the slurry having the applicable concentration is then supplied to the CMP apparatus.

A conventional apparatus for separating slurry by particle size/specific gravity includes a housing containing a cyclone. The cyclone has an inlet passageway through which the slurry is introduced, and a cylindrical passageway and a conical passageway in which the slurry is rotated. A drawback to this system is that such conventional cyclones are known to be relatively inefficient at separating the slurry particles.

A further drawback is the spaced arrangement between the apparatus separating the particles of the slurry and the unit mixing the particles back into the slurry. Such spacing requires the separated slurry to be transported in a container between the two stations. While being transported, however, the above-mentioned agglomeration mechanism causes macro-particles to again be formed within the container.

Accordingly, the need remains for a cyclone with improved separating efficiency as well as a system that integrally separates the slurry and mixing the slurry with deionized water.

SUMMARY OF THE INVENTION

To provide the slurry with a strong centrifugal force, a cyclone constructed according to a preferred embodiment of the invention is provided with an inlet passageway, a cylindrical passageway, and a conical passageway with optimized relative ratios between their lengths. Further, the housing of the cyclone is constructed to include an inlet that is in fluid communication with the inlet passageway of the cyclone and having a structural shape that reduces the normally very high shear stresses that are applied to the slurry passing through the inlet.

A cyclone in accordance with one aspect of the present invention includes a body and a vortex finder. The body includes an inlet passageway, a cylindrical passageway connected to the inlet passageway, and a conical passageway connected to the cylindrical passageway. The cylindrical passageway has an upper end through which first particles in a fluid are exhausted, and a lower end. The conical passageway has an upper end connected to the lower end of the cylindrical passageway, and an opened lower end through which second particles having a specific gravity greater than that of the first particle are exhausted. The vortex finder is connected to the upper end of the cylindrical passageway. A first exhaust passageway is vertically formed in the vortex finder. The first particles spirally ascend through the first exhaust passageway from the cylindrical passageway. The cylindrical passageway has a vertical length of about 0.5 times to about 2 times a diameter of the cylindrical passageway. The conical passageway has a vertical length of about 5 times to about 9 times the diameter of the cylindrical passageway.

An apparatus for separating slurry in accordance with another aspect of the present invention includes a housing and a cyclone. The housing includes an inlet through which the slurry is introduced, a rounded distribution passageway connected to the inlet, a receiving space for receiving the cyclone, a first exhaust outlet through which first particles in the slurry are exhausted, and a second exhaust outlet through which second particles in the slurry having a specific gravity greater than that of the first particle are exhausted. The receiving space has an upper end connected to the distribution passageway, and a lower end. The second exhaust outlet is connected to the lower end of the receiving space. The cyclone includes a body and a vortex finder. The body includes an inlet passageway connected to the distribution passageway, a cylindrical passageway connected between the inlet passageway and the first exhaust outlet, and a conical passageway connected between the cylindrical passageway and the second exhaust outlet. The vortex finder is inserted into the cylindrical passageway. A first exhaust passageway is vertically formed in the vortex finder. The first exhaust passageway is connected between the cylindrical passageway and the first exhaust outlet.

A system for supplying slurry to an object in accordance with still another aspect of the present invention includes a slurry drum for containing preliminary slurry, a reproducing unit and a mixing unit. The reproducing unit reproduces slurry having a size used for a chemical mechanical polishing (CMP) process from the preliminary slurry. The mixing unit mixes the reproduced slurry and deionized water to form final slurry having a concentration used for the CMP process.

According to one embodiment, the reproducing unit includes a preliminary slurry tank, an apparatus for separating the preliminary slurry, and a supersonic pulverizing apparatus. The preliminary slurry tank receives the preliminary slurry from the slurry drum. The apparatus for separating the preliminary slurry is connected to the preliminary slurry tank through a preliminary slurry line and a first return line. The apparatus separates first particles and second particles having a size larger than that of the first particles from the preliminary slurry. The supersonic pulverizing apparatus pulverizes the second particles returned through the first return line using a supersonic wave.

According to another embodiment, the mixing unit includes a deionized water tank for containing the deionized water, and a mixing tank for mixing the reproduced slurry and the deionized water. The mixing tank is connected to the deionized water tank and the reproducing unit, respectively.

In a method of supplying slurry to an object in accordance with still another aspect of the present invention, preliminary slurry is primarily pulverized. Particles in the primarily pulverized slurry are separated into first particles and second particles having a size larger than that of the first particles. The second particles are secondarily pulverized. The primarily pulverized first particles and the secondarily pulverized second particles are mixed with deionized water to form final slurry. The final slurry is then provided to the object.

According to the present invention, the cyclone includes passageways having optimal length ratios therebetween so that efficiency for separating the slurry may be considerably improved. Further, the apparatus for separating the slurry has a rounded distribution passageway so that shear stresses applied to the slurry may be markedly reduced. Furthermore, the process for reproducing the slurry and the process for mixing the reproduced slurry and the deionized water are carried out in one directly connected system so that the system may have a simple structure. Thus, since it is not necessary to transport the separated slurry to the mixing unit, macro-particles may not be generated in the slurry.

BRIEF DESCRIPTION OF THE DRAWINGS

The above and other features and advantages of the invention will become readily apparent by reference to the following detailed description when considered in conjunction with the accompanying drawings wherein.

DESCRIPTION OF THE EMBODIMENTS

Figure 1:
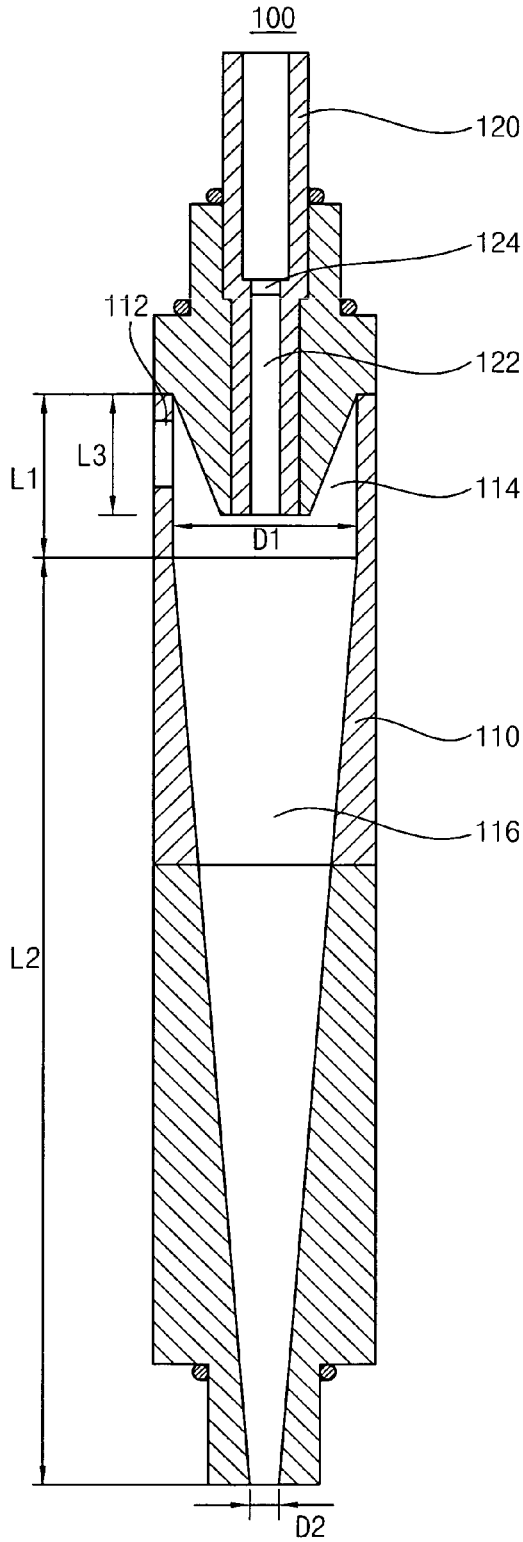
FIG. 1 is a cross sectional view illustrating a cyclone constructed in accordance with an exemplary embodiment of the present invention.

The present invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Cyclone

FIG. 1 is a cross sectional view illustrating a cyclone in accordance with an example embodiment of the present invention.

Referring to FIG. 1, a cyclone 100 of the present embodiment includes a body 110 and a vortex finder 120.

The body 110 has an inlet passageway 112 through which a fluid such as slurry is introduced, a cylindrical passageway 114 connected to the inlet passageway 112, and a conical passageway 116 connected to the cylindrical passageway 114. Here, the body 110 may be formed of or surfaced with a silicon carbide.

The inlet passageway 112 is formed through an upper sidewall of the body 110 in a horizontal direction. Here, efficiency for separating the slurry is increased proportional to a decrease of a diameter of the inlet passageway 112. Further, the efficiency for separating the slurry is increased still more in an amount proportional to an increase of a speed of the slurry that passes through the inlet passageway 112.

The cylindrical passageway 114 is formed in the body 110 in a vertical direction substantially perpendicular to the horizontal direction. The cylindrical passageway 114 has an upper end connected to the inlet passageway 112, and a lower end having a diameter D1 substantially identical to that of the upper end of the cylindrical passageway 114. Further, the inlet passageway 112 may have a diameter of about ¼ times to about ⅓ times the diameter D1 of the cylindrical passageway.

The conical passageway 116 has an upper end connected to the lower end of the cylindrical passageway 114, and an opened lower end. In particular, the conical passageway 116 has diameters that are gradually reduced from the upper end to the lower end of the conical passageway 116. Thus, the conical passageway 116 has an inclined inner wall having an inclined angle of about 10° to about 30° with respect to the vertical direction.

The slurry is introduced into the cylindrical passageway 14 and the conical passageway 116 through the inlet passageway 112. A high pressure is introduced into the cylindrical passageway 114 and the conical passageway 116 to rotate the slurry in the cylindrical passageway 114 and the conical passageway 116, thereby separating particles in the slurry by sizes. Thus, first particles in the slurry having the lightest specific gravity are distributed in an upper region of the conical passageway 116. Second particles in the slurry, having the heaviest specific gravity are distributed in a lower region of the conical passageway 116. Third particles, with a specific gravity between the first and second particles, are distributed in the middle region of the conical passageway.

Here, the particles in the slurry are still more minutely separated proportional to increasing rotation numbers of the slurry in the cylindrical passageway 114 and the conical passageway 116 since the rotation numbers of the slurry are proportional to a vertical length L1 of the cylindrical passageway 114 and a vertical length L2 of the conical passageway 116. Thus, the cylindrical passageway 114 and the conical passageway 116 have preferably long vertical lengths, respectively.

Particularly, the vertical lengths L1 and L2 of the cylindrical passageway 114 and the conical passageway 116, respectively, are closely related to the diameter D1 of the cylindrical passageway 114. When the diameter D1 of the cylindrical passageway 114 is large, the cylindrical passageway 114 and the conical passageway 116 have a very large inner space, although the vertical lengths L1 and L2 of the cylindrical passageway 114 and the conical passageway 116 are long. The rotation numbers of the slurry are reduced in the very large inner space. Thus, to improve the efficiency for separating the slurry, the vertical lengths L1 and L2 of the cylindrical passageway 114 and the conical passageway 116 are determined in accordance with the diameter D1 of the cylindrical passageway 114. Further, to still more improve the efficiency for separating the slurry where the specific gravities of the particles in the slurry have slight differences therebetween, it is required to increase a ratio of the vertical length L2 of the conical passageway 116 with respect to the vertical length L1 of the cylindrical passageway 114. Meanwhile, a lower end of the conical passageway 116 may have a diameter D2 of about 1/10 times to about ⅙ times the diameter D1 of the cylindrical passageway 114.

In the present embodiment, the vertical length L1 of the cylindrical passageway 114 is about 0.5 times to about 2 times the diameter D1 of the cylindrical passageway 114. Further, the vertical length L1 of the conical passageway 116 is about 5 times to about 9 times the diameter D1 of the cylindrical passageway 114. An effect exhibited from the above-mentioned definition of the vertical lengths L1 and L2 of the cylindrical passageway 114 and the conical passageway 116 will be proved by a following test later illustrated.

The vortex finder 120 is inserted into the cylindrical passageway 114 through an upper end of the body 110. A first exhaust passageway 122 for exhausting the first particles is formed in the vortex finder 120 in the vertical direction. To prevent the rotated first particles from being exhausted through the inlet passageway 112, the first exhaust passageway 122 has a lower end that is positioned lower than the inlet passageway 112 within the cylindrical passageway 114 space.

Here, to still more improve the efficiency for separating the slurry, a vertical length of the first exhaust passageway 122, particularly a vertical length L3 between the upper end of the cylindrical passageway 114 and the lower end of the first exhaust passageway 122 may be determined in accordance with the diameter D1 of the cylindrical passageway 114. The vertical length L3 may be about 0.6 times to about 1.2 times the diameter D1 of the cylindrical passageway 114. Further, the vortex finder 120 may have a diameter of about ⅙ times to about ⅓ times the diameter D1 of the cylindrical passageway 112.

In addition, the vortex finder 120 may include a second exhaust passageway 124 for exhausting third particles that have a specific gravity greater that that of the first particles and less than that of the second particles. The second exhaust passageway 124 is connected to the first exhaust passageway 122 in the horizontal direction.

The slurry is introduced into the cyclone 100 through the inlet passageway 112. The high pressure is provided into the cylindrical passageway 114 and the conical passageway 116 so that the slurry is rotated in the cylindrical passageway 114 and the conical passageway 116. Thus, the particles in the slurry are separated in accordance with the specific gravities of the particles. That is, the first particles having the lowest specific gravity are distributed in the upper region of the cyclone 100, the third particles having a middle specific gravity are distributed in the middle region of the cyclone 100, and the second particles having the heaviest specific gravity are distributed in the lower region of the cyclone 100. The first particles are exhausted through the first exhaust passageway 122. The third particles are exhausted through the second exhaust passageway 124. Finally, the second particles such as macro-particles are exhausted through the lower end of the conical passageway 116.

Apparatus for Separating Slurry

Figure 2:
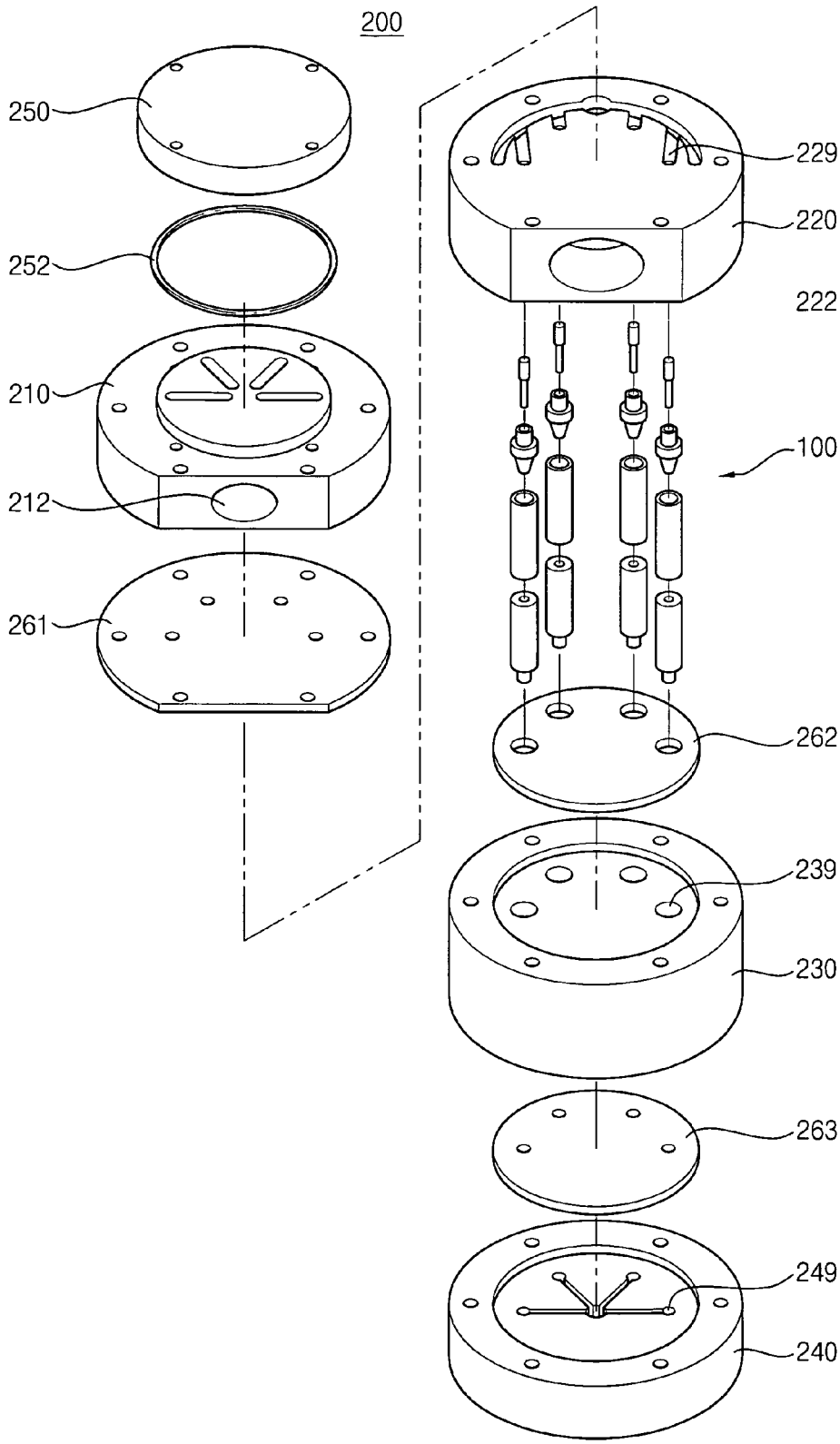
FIG. 2 is an exploded perspective view illustrating an apparatus for separating slurry in accordance with an exemplary embodiment of the present invention.
Figure 3:
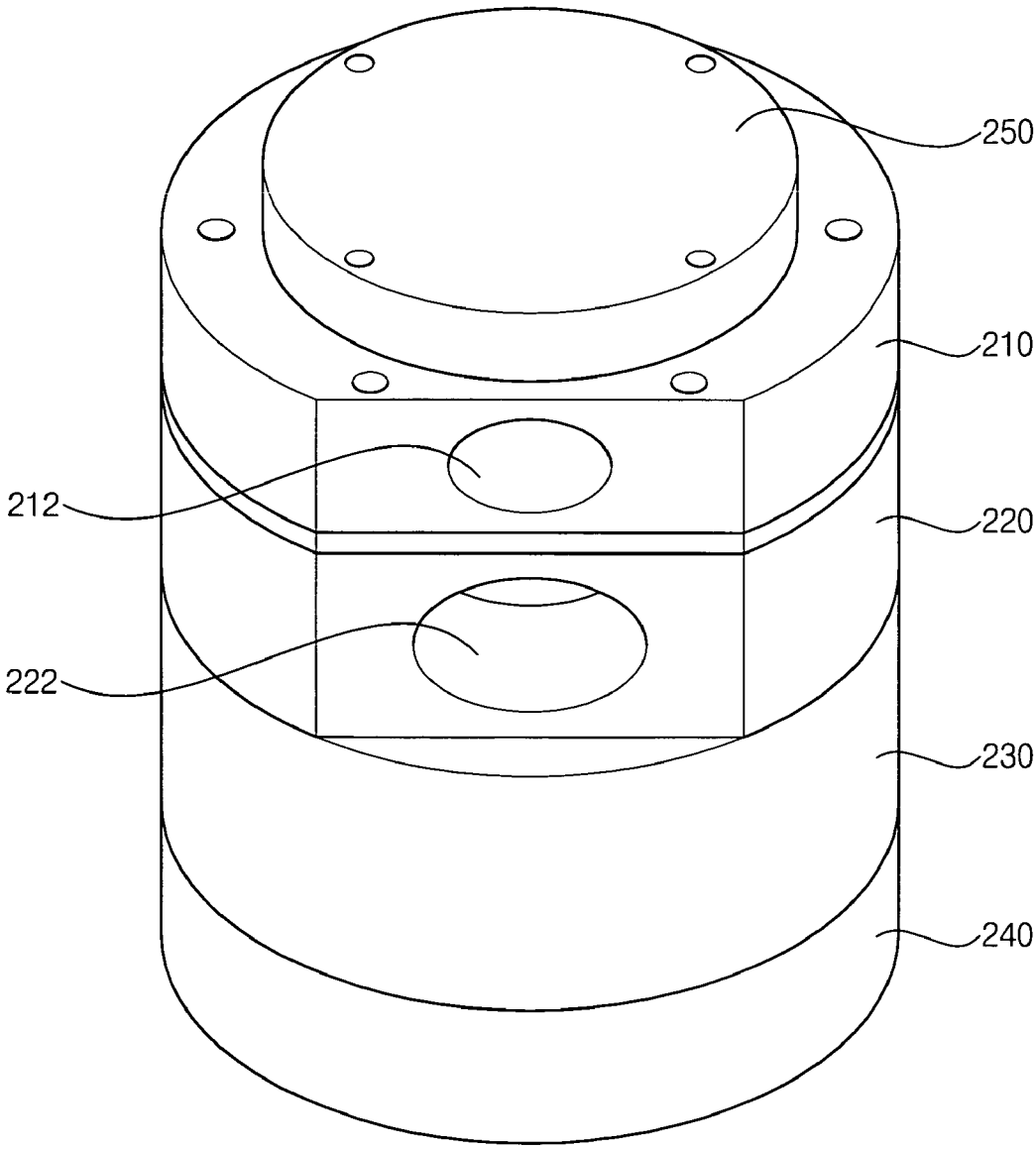
FIG. 3 is a perspective view illustrating the apparatus in FIG. 2.
Figure 4:
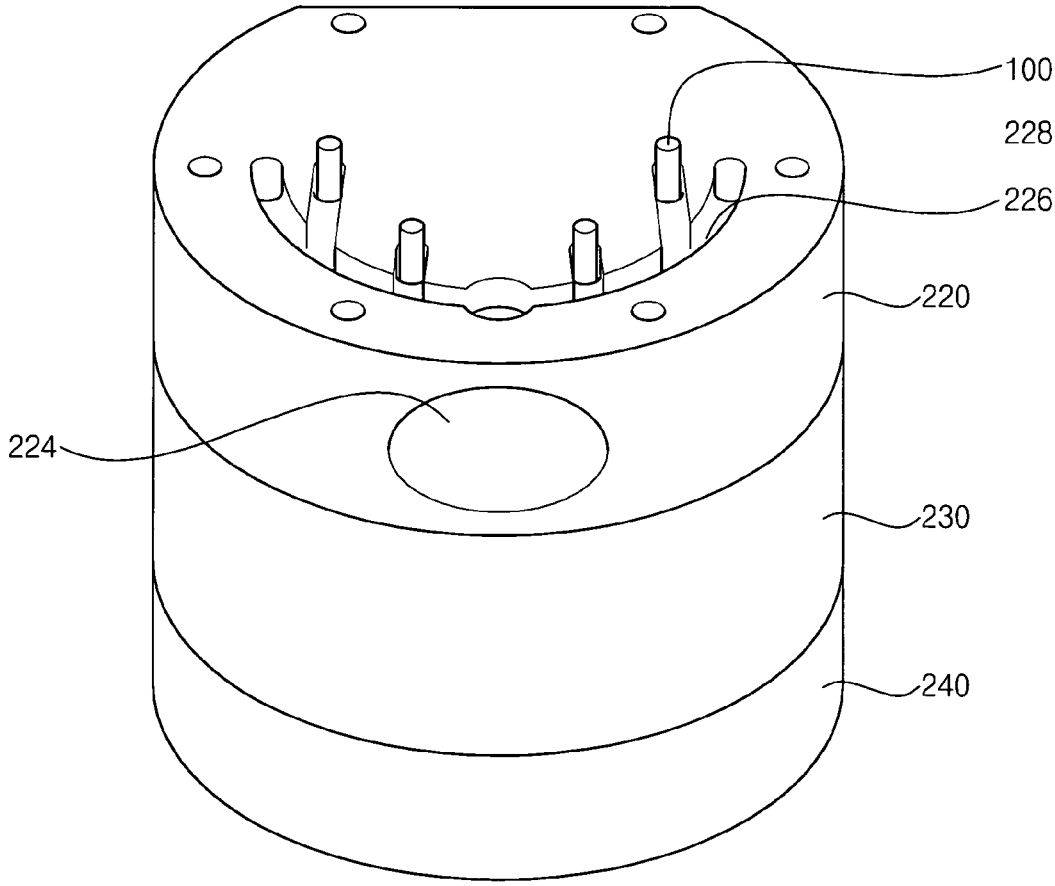
FIG. 4 is a perspective view illustrating the apparatus in FIG. 3 from which a first block is removed.
Figure 5:
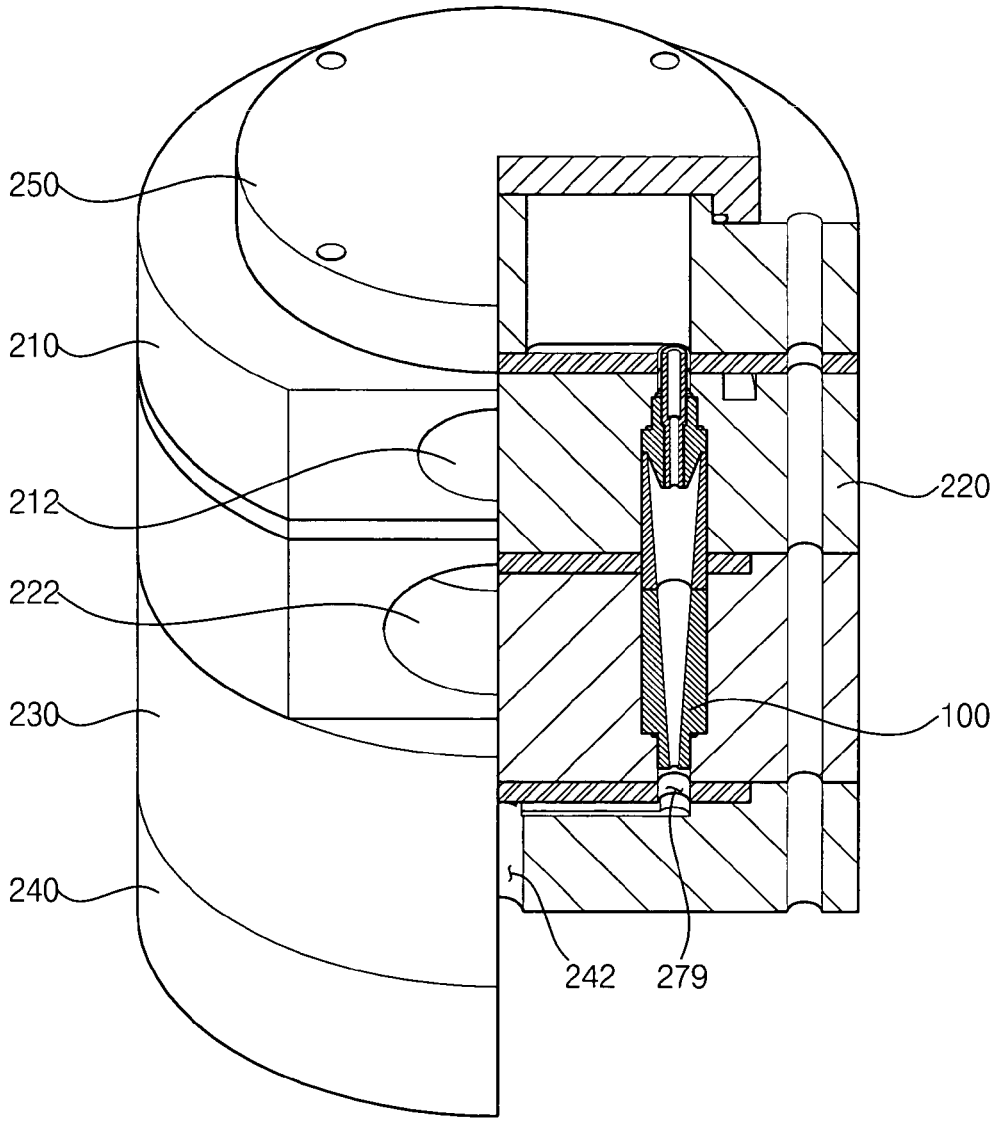
FIG. 5 is a partially sectioned perspective view illustrating an inner structure of the apparatus in FIG. 3.

FIG. 2 is an exploded perspective view illustrating an apparatus for separating slurry in accordance with an exemplary embodiment of the present invention, FIG. 3 is a perspective view illustrating the apparatus in FIG. 2, FIG. 4 is a perspective view illustrating the apparatus in FIG. 3 from which a first block is removed, and FIG. 5 is a partially cut perspective view illustrating an inner structure of the apparatus in FIG. 3.

Referring to FIGS. 2 and 3, an apparatus 200 for separating slurry of the present embodiment includes a housing and at least one cyclone 100 received in the housing. Here, the cyclone 100 includes elements substantially identical to those in FIG. 1. Thus, same reference numerals refer to the same elements and any further illustrations with respect to the same elements are omitted herein.

The housing includes a first block 210, a second block 220, a third block 230 and a fourth block 240. The second block 220 is combined with a lower face of the first block 210. The third block 230 is combined with a lower face of the second block 220. The fourth block 240 is combined with a lower face of the third block 230. To enhance coherence forces between the first to fourth blocks 210, 220, 230 and 240, first to third supporting plates 261, 262 and 263 are interposed between the first to fourth blocks 210, 220, 230 and 240, respectively. Further, a cover 250 is combined with an upper face of the first block 210. An O-ring 252 is interposed between the cover 250 and the upper face of the first block 210. Here, in the present embodiment, the housing has a multi-blocked structure. Alternatively, the housing may have a single-block structure.

A first receiving hole (not shown) is formed from the lower face of the first block 210 in a vertical direction. A second receiving hole 229 is formed through the second block 220 in the vertical direction. A third receiving hole 239 is formed through the third block 230 in the vertical direction. A fourth receiving hole 249 is formed from an upper face of the fourth block 240 in the vertical direction. The first receiving hole, the second receiving hole 229, the third receiving hole 239 and the fourth receiving hole 249 are connected to each other in series to form a receiving space 279 (see FIG. 5) for receiving the cyclone 100. Holes in communication with the first receiving hole, the second receiving hole 229, the third receiving hole 239 and the fourth receiving hole 249, respectively, are formed through the first to third supporting plates 261, 262 and 263, respectively.

An inlet 222 through which slurry is introduced is formed through the second block 220 in a horizontal direction substantially perpendicular to the vertical direction. As shown in FIG. 4 a rounded distribution passageway 226 connected to the inlet 222 is formed at the upper face of the second block 220. In the present embodiment, the distribution passageway 226 has a semi-circular shape. Four diverged passageways 228 are formed at the upper face of the second block 220 from the distribution passageway 226 to a center of the second block 220. Each of the diverged passageways 228 is connected to the receiving space 279, respectively, so that the slurry is introduced into the inlet passageway 112 of the cyclone 110 through the diverged passageways 228. Here, the slurry flows through the semi-circular distribution passageway 226. Thus, relatively low shear stresses may be applied to the slurry from a rounded inner wall of the distribution passageway 226. As a result, the slurry smoothly flows through the distribution passageway 226 and is then introduced into the cyclone 100.

A third exhaust outlet 224 is formed through a side face of the second block 220 in the horizontal direction. The third particles separated by the cyclone 100 are exhausted through the third exhaust outlet 224. Thus, the third exhaust outlet 224 is in communication with the second exhaust passageway 124 of the cyclone 100.

Here, in the present embodiment, since the number of the cyclones 100 is four, the number of the receiving spaces for receiving the four cyclones 100 is four. Alternatively, the number of the cyclone 100 may vary in accordance with an amount of the slurry.

A first exhaust outlet 212 is formed through a side face of the first block 210 in the horizontal direction. The first exhaust outlet 212 is opposite to the third exhaust outlet 224. The first particles separated by the cyclone 100 are exhausted through the first exhaust outlet 212 via the first exhaust passageway 122.

Referring to FIG. 5, a second exhaust outlet 242 is formed from the lower face of the fourth block 240 in the vertical direction. The second exhaust outlet 242 is in communication with the fourth receiving hole 249 (FIG. 2). Thus, the second exhaust outlet 242 is connected to a lower end of the cyclone 100 so that the second particles are exhausted through the second exhaust outlet 242.

In the present embodiment, the exemplarily housing includes the four blocks 210, 220, 230 and 240. Alternatively, it may not be necessarily to provide the housing with the third block 230. That is, the housing may selectively include the third block 230 in accordance with a length of the cyclone 100.

System for Supplying Slurry

Figure 6:
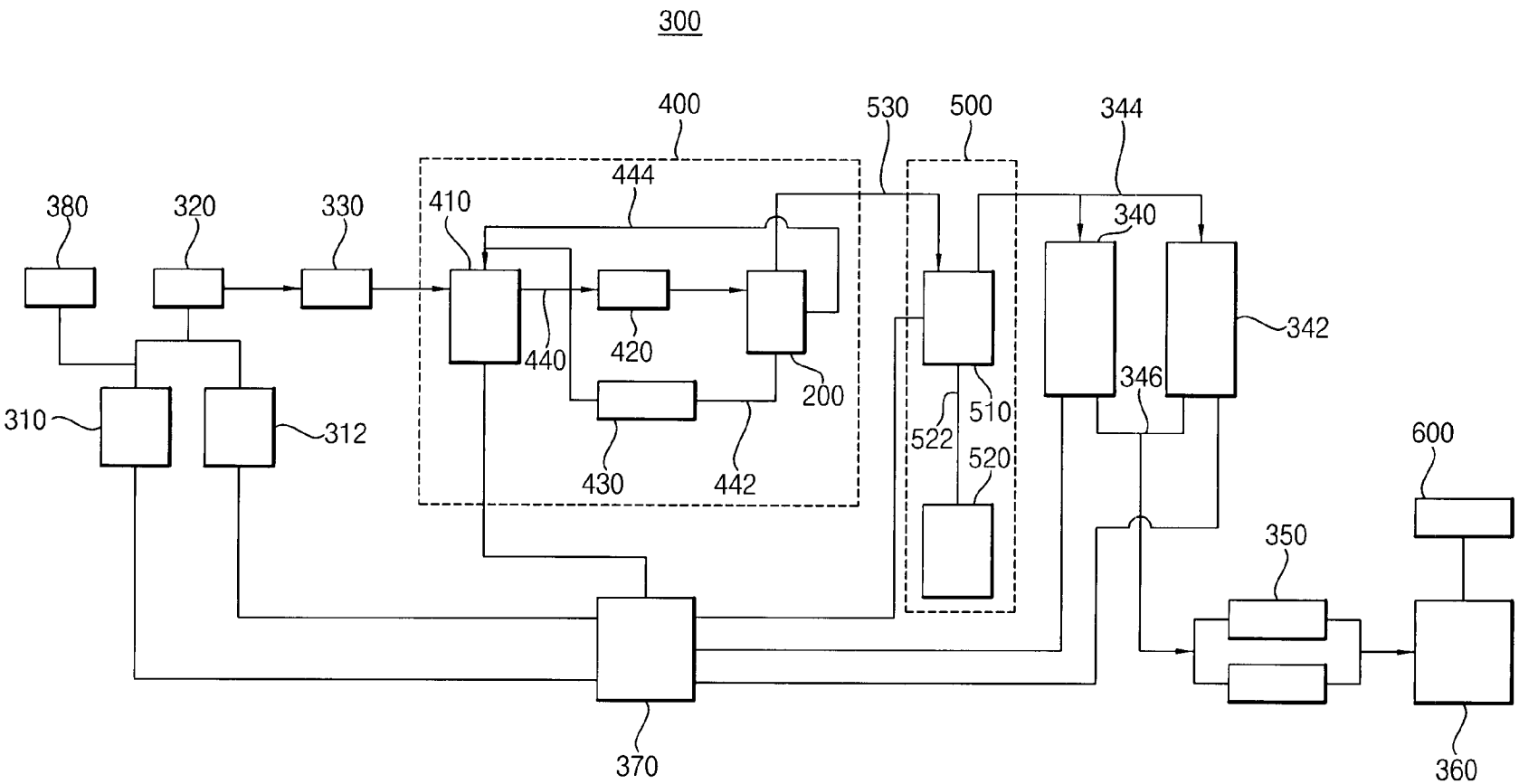
FIG. 6 is a block diagram illustrating a system for supplying slurry in accordance with an exemplary embodiment of the present invention.
Figure 7:
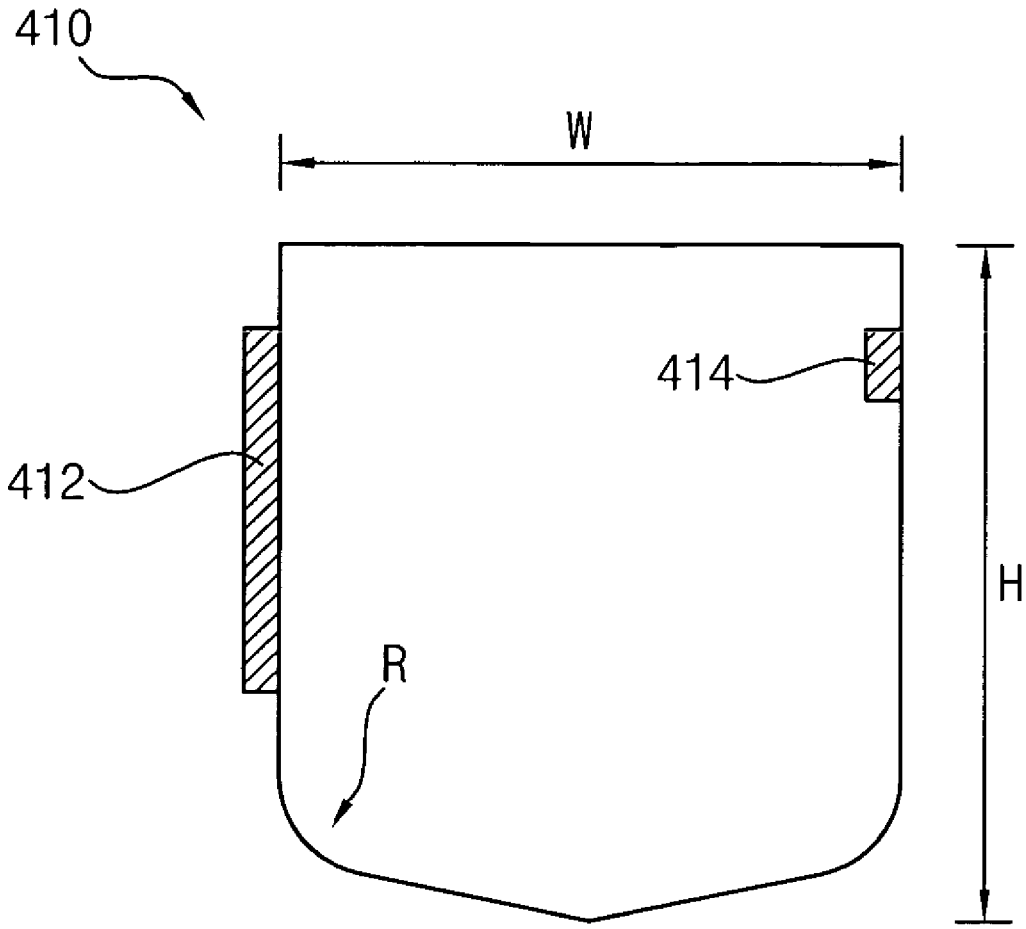
FIG. 7 is a cross sectional view illustrating an inner structure of a preliminary slurry tank in a reproducing unit of the system in FIG. 6.
Figure 8:
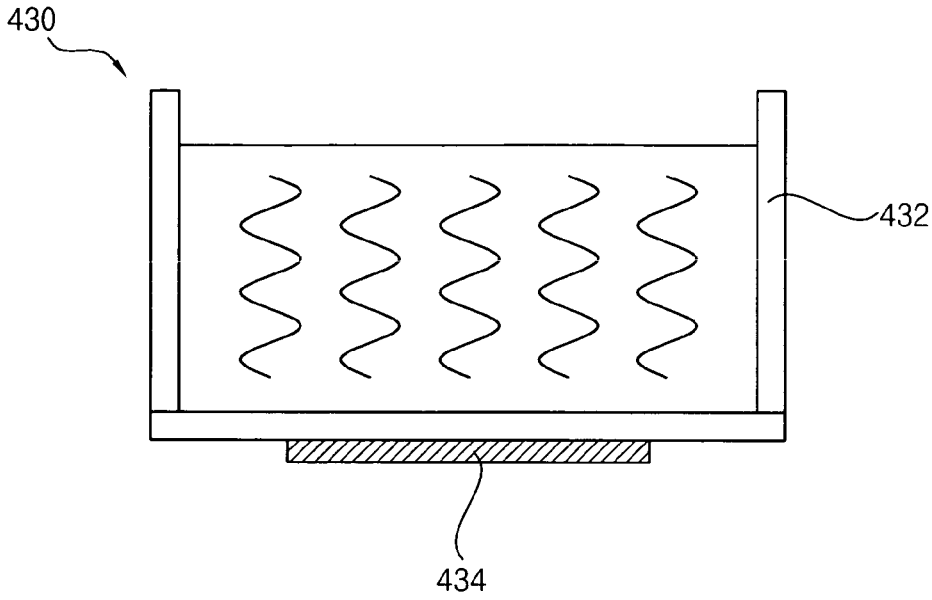
FIG. 8 is a cross sectional view illustrating a supersonic pulverizing apparatus of the reproducing unit in FIG. 6.
Figure 9:
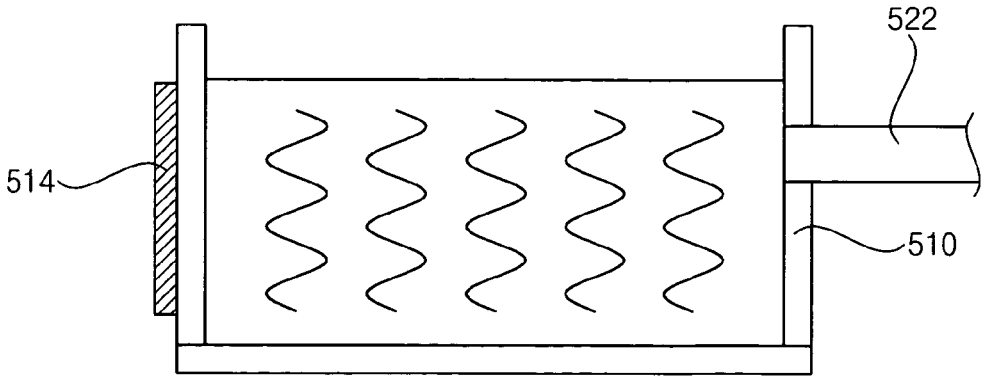
FIG. 9 is a cross sectional view illustrating a mixing tank of a mixing unit in FIG. 6.

FIG. 6 is a block diagram illustrating a system for supplying slurry in accordance with an exemplary embodiment of the present invention, FIG. 7 is a cross sectional view illustrating an inner structure of a preliminary slurry tank in a reproducing unit of the system in FIG. 6, FIG. 8 is a cross sectional view illustrating a supersonic pulverizing apparatus of the reproducing unit in FIG. 6, and FIG. 9 is a cross sectional view illustrating a mixing tank of a mixing unit in FIG. 6.

Referring to FIG. 6, a system 300 of the present embodiment includes two slurry drums 310 and 312 for containing preliminary slurry, a reproducing unit 400 for reproducing slurry having a size used for a CMP process from the preliminary slurry, and a mixing unit 500 for mixing the reproduced slurry with deionized water to form final slurry having a concentration applicable for the CMP process.

The number of the slurry drums 310 and 312 is preferably two and are coupled to continuously supply slurry to the reproducing unit 400 from first one of the slurry drums and then the other without an intervening suspension of supply. An empty slurry drum is filled with new preliminary slurry. However, it is obvious to those skilled in the art that the number of the slurry drum may be one or at least three.

A pump 320 supplies the reproducing unit 400 with the preliminary slurry in the slurry drums 310 and 312. The pump 320 may include a bellows type pump. Here, the preliminary slurry may include macro-particles. When the reproducing unit 400 reproduces slurry from preliminary slurry having the macro-particles, an efficiency for reproducing the slurry may be decreased.

To prevent the efficiency for reproducing slurry from decreasing, a first filter 330 removes the macro-particles in the preliminary slurry. The first filter 330 has a grid structure for preventing macro-particles having a size larger than that of the grid from passing through the grid structure.

The reproducing unit 400 includes a preliminary slurry tank 410 for containing the preliminary slurry that passes through the first filter 330, the apparatus 200 for separating the particles in the preliminary slurry by specific gravities, and a supersonic pulverizing apparatus 430 for pulverizing the second particles having a highest specific gravity using a supersonic wave. A pump 420 provides a high pressure to the preliminary slurry supplied to the separating apparatus 200 so that a centrifugal force is applied to the preliminary slurry. Here, the apparatus 200 for separating the preliminary slurry is illustrating in detail with reference to FIGS. 2 to 5. Thus, same reference numerals refer to same elements and any further illustrations with respect to the same elements are omitted herein.

The reproducing unit 400 is connected to the preliminary slurry tank 410 through a preliminary slurry line 440. The pump 420 is installed in the preliminary slurry line 440. The second particles separated by the separating apparatus 200 are returned to the preliminary slurry tank 410 through a first return line 442. The third particles are returned to the preliminary slurry tank 410 through a second return line 444. The supersonic pulverizing apparatus 430 for pulverizing the second particles using supersonic waves is installed in the first return line 442.

Referring to FIG. 7, the preliminary slurry tank 410 has a cylindrical shape with a height H and a width W. To suppress evaporation within the preliminary slurry and accumulating by precipitation of high specific gravity preliminary slurry particles on a bottom face of the preliminary slurry tank, a ratio between the height H and the width W may be about 1:0.5 to about 1:0.8. Further, to prevent the preliminary slurry from stagnating in the preliminary slurry tank 410, the preliminary slurry tank 410 may have a downwardly convex bottom face as shown in FIG. 7. In particular, a radius of curvature between the downwardly convex bottom face and a side face of the preliminary slurry tank 410 may be about 50 mm.

Turning to FIG. 7, a vibrator 412 is mounted on an outer wall of the preliminary slurry tank 410. The vibrator 412 suppresses the preliminary slurry from being agglomerated in the preliminary slurry tank 410. The vibrator 412 applies a high frequency of no less than about 500 kHz to the preliminary slurry to generate supersonic waves. The supersonic waves pulverize agglomerated particles.

In addition, a level sensor 414 for sensing a level of the preliminary slurry is attached to an inner wall of the preliminary slurry tank 410. Further, the preliminary slurry tank 410 may include fluorine resin.

Referring to FIG. 8, the supersonic pulverizing apparatus 430 includes a supersonic tank 432 for containing the second particles, and a vibrator 434 mounted beneath a bottom face of the supersonic tank 432. The vibrator 434 applies a high frequency of no less than about 500 kHz to the second particles to pulverize the second particles. In particular, the vibrator 434 has a plate shape having an area substantially identical to that of the bottom face of the supersonic tank 432. Thus, the vibrator 434 uniformly applies the high frequency to the second particles to improve the pulverizing efficiency.

Referring now to FIG. 6, the apparatus 200 for separating the preliminary slurry separates the preliminary slurry into the first, second and third particles by the specific gravities thereof. The first particles having a lightest specific gravity are directly supplied to the mixing unit 500. The third particles having a middle specific gravity are returned the preliminary slurry tank 410 through the second return line 444. The returned third particles are again provided into the apparatus 200 through pump 420. The apparatus 200 again separates the returned third particles. The supersonic pulverizing apparatus 430 pulverizes the third particles having a highest specific gravity. The pulverized third particles are then returned to the preliminary slurry tank 410. The pulverized third particles are again supplied to the apparatus 200. The apparatus 200 again separates the pulverized third particles. This cycle is continuously repeated so that heavier particles are reprocessed until the preliminary slurry only includes the first particles having the lightest specific gravity. As a result, all of the preliminary slurry may be used without generating of scrapped preliminary slurry.

The reproduced slurry having an amount substantially identical to that of the preliminary slurry is directly supplied to the mixing unit 500 through a connection line 530. That is, in the present embodiment, since the reproducing unit 400 is directly connected to the mixing unit 500, there is not need to transport the reproduced slurry to the mixing unit 500 using additional transporting equipment. There is therefore minimal opportunity for the reproduced slurry to become agglomerated during the transport process.

The mixing unit 500 includes a mixing tank 510 directly connected to the apparatus 200 for separating slurry through the connection line 530, and a deionized water tank 520 for containing the deionized water to be provided to the mixing tank 510.

Referring to FIG. 9, the mixing tank 510 is connected to the deionized water tank 520 through a deionized water line 522. To reduce a mixing of the reproduced slurry and the final slurry, a vibrator 514 is mounted on an outer wall of the mixing tank 510 and applies a high frequency to the reproduced slurry and the final slurry.

Referring now to FIG. 6, the final slurry prepared by the mixing unit 500 is supplied to two slurry tanks 340 and 342 through a slurry line 344. The slurry tanks 340 and 342 are connected to each other through a circulation line 346. Thus, the final slurry in the slurry tanks 340 and 342 is continuously circulated through the circulation line 346 to prevent stagnation and prevent subsequent agglomeration of the slurry into macro-particles.

In addition, to prevent the preliminary slurry, the reproduced slurry and the final slurry from being agglomerated, the system 300 for supplying slurry may include a humidified gas-supplying unit 370 for supplying a humidified gas including nitrogen to the preliminary slurry, the reproduced slurry and the final slurry. The humidified gas-supplying unit 370 is connected to the slurry drums 310 and 312, the preliminary slurry tank 410, the supersonic tank 510 and the slurry tanks 340 and 342, respectively. In particular, the humidified gas provided to the slurry tanks 340 and 342 functions as to provide a pressure for circulating the final slurry in the slurry tanks 340 and 342 to the final slurry.

Further, the system 300 for supplying slurry may include a cleaning unit 380. The cleaning unit 380 provides a cleaning solution including KOH to the system 300 to remove remaining slurry on an inner wall of the system 300.

Furthermore, the final slurry in the slurry tanks 340 and 342 passes through a second filter 350 to finally remove macro-particles and foreign substances in the final slurry. To recognize a concentration of the final slurry, which passes through the second filter 350, suitable for the CMP process, a densitometer 360 measures the concentration of the final slurry. The final slurry having a normal concentration is supplied to a CMP apparatus 600.

Method of Supplying Slurry

Figure 10:
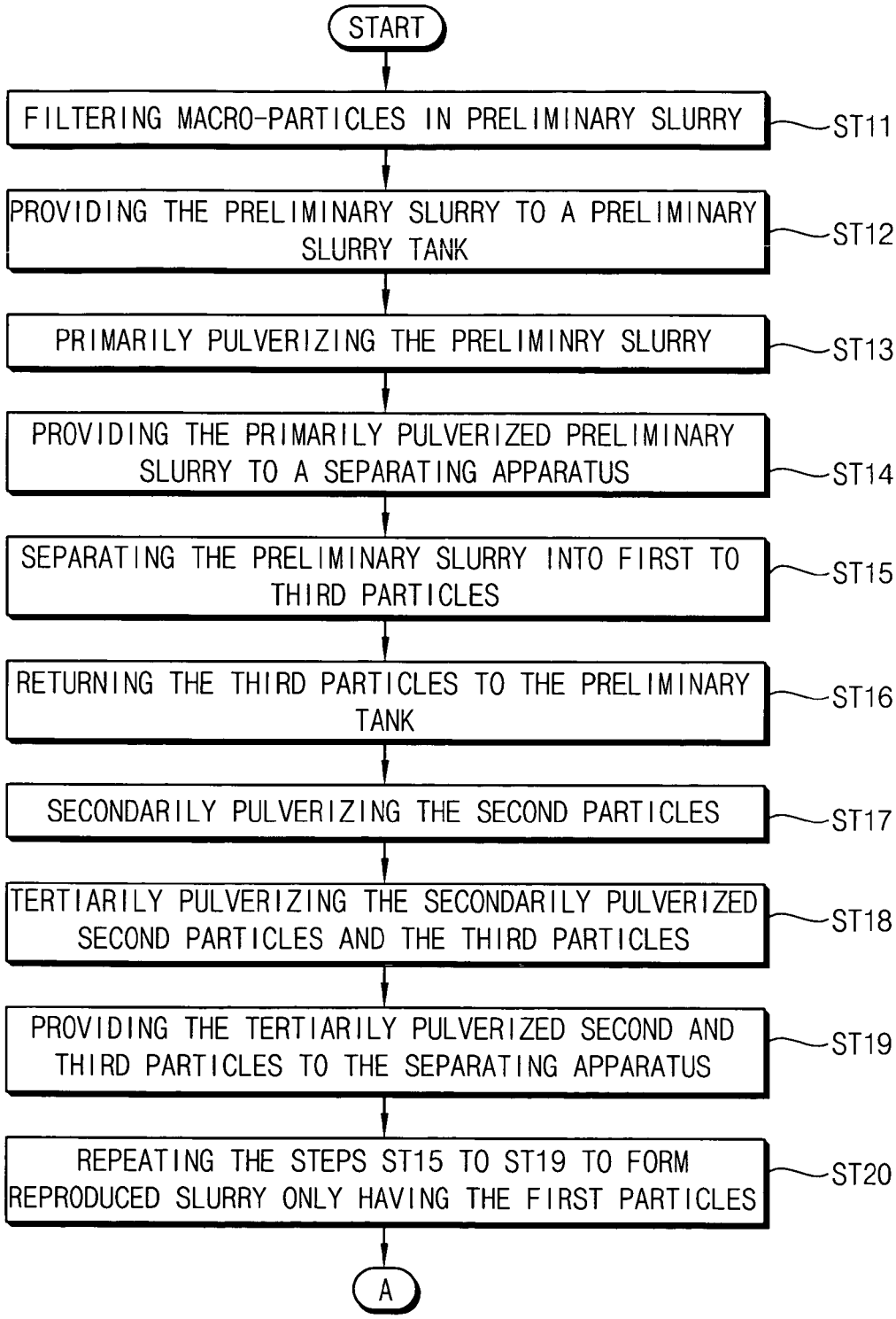
FIGS. 10 and 11 are flow charts illustrating a method of supplying slurry using the system in FIG. 6.
Figure 11:
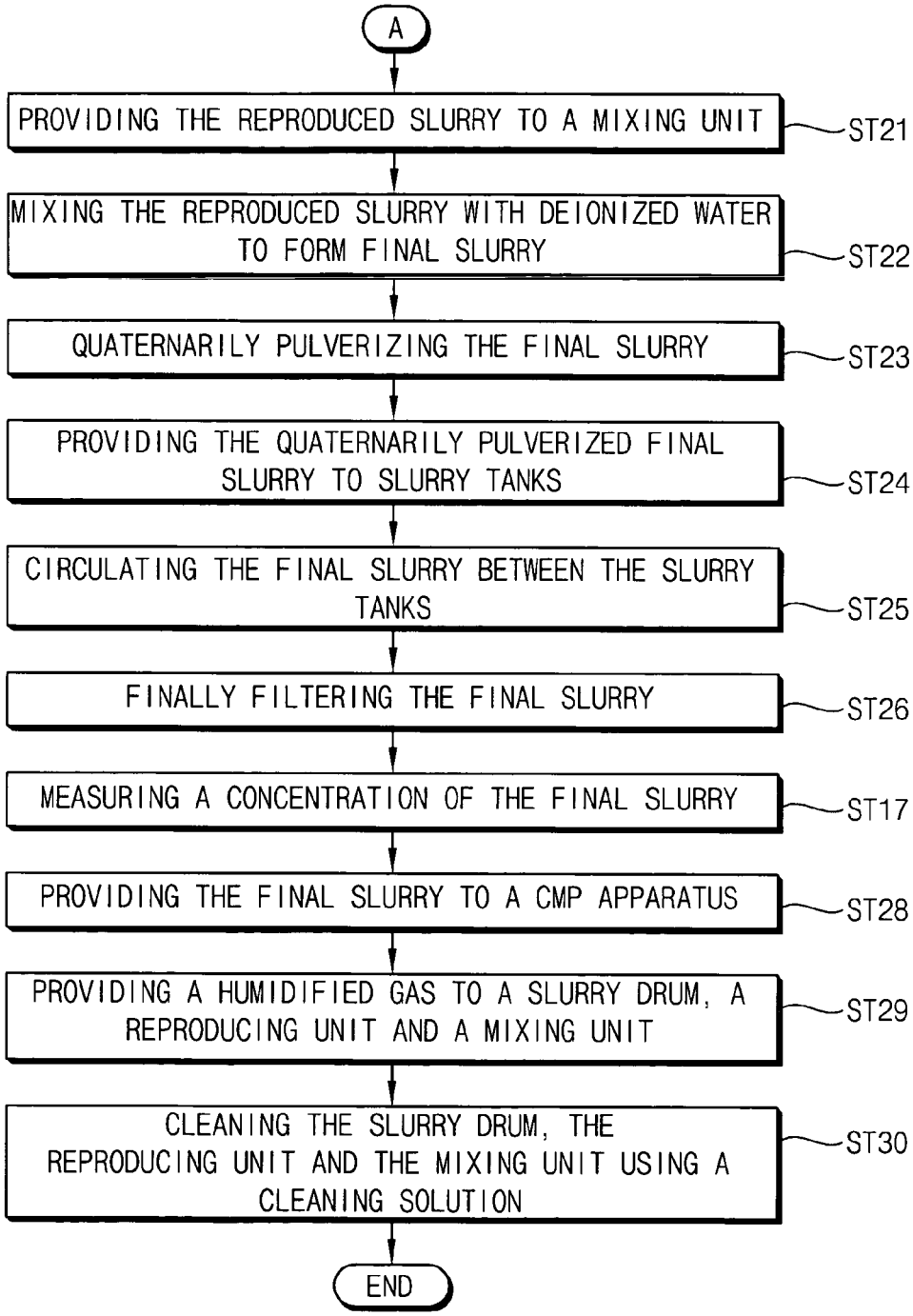

FIGS. 10 and 11 are flow charts illustrating a method of supplying slurry using the system in FIG. 6.

Referring to FIGS. 6, 10 and 11, in step ST11, the preliminary slurry in the slurry drum 310 passes through the first filter 330 using the pump 320 to remove the macro-particles in the preliminary slurry.

In step ST12, the preliminary slurry from which the macro-particles are removed is supplied to the preliminary slurry tank 410.

In step ST13, the vibrator 412 applies the supersonic waves to the preliminary slurry to primarily pulverize the preliminary slurry. Here, the vibrator 412 continuously pulverizes the preliminary slurry in the preliminary slurry tank 410 so that the preliminary slurry in the preliminary slurry tank 410 does not become agglomerated.

In step ST14, the primarily pulverized preliminary slurry is provided to the apparatus 200 for separating slurry.

In step ST15, the pump 420 applies a high pressure to the preliminary slurry in the apparatus 200 to separate the preliminary slurry into the first particles having a specific gravity, a third particles having a specific gravity heavier than that of the first particles, and second particles having a specific gravity heavier than that of the third particles. That is, the first particles have the lightest specific gravity and the second particles have the heaviest specific gravity.

In step ST16, the third particles are returned to the preliminary slurry tank 410 through the second return line 444.

In step ST17, the second particles are introduced into the supersonic pulverizing apparatus 430 through the first return line 442 where. The vibrator 434 of the supersonic pulverizing apparatus 430 applies the supersonic waves to the second particles to secondarily pulverize the second particles. The secondarily pulverized second particles are returned to the preliminary slurry tank 410 though the first return line 442 where the secondarily pulverized second particles are mixed with the third particles.

In step ST18, the second and third particles in the preliminary slurry tank 410 are tertiarily pulverized.

In step ST19, the tertiarily pulverized second and third particles are again supplied to the apparatus 200 for separating slurry.

In step ST20, the above-mentioned steps ST15 to ST19 are repeated to form the reproduced slurry only including the first particles.

In step ST21, the reproduced slurry is directly provided to the mixing tank 510 of the mixing unit 500 through the connection line 530. That is, since the reproducing unit 400 and the mixing unit 500 are directly connected to each other through the connection line 530, there is not need to transport the reproduced slurry to the mixing unit 500 using additional transportation equipment. Thus, macro-particles are not generated in the reproduced slurry during the transmission process to the mixing unit 500 through connection line 530 (FIG. 6).

In step ST22, the deionized water in the deionized water tank 520 is provided to the mixing tank 512. The deionized water is mixed with the reproduced slurry in the mixing tank 512 to form the final slurry having a concentration applicable for the CMP process.

In step ST23, the supersonic waves are applied to the final slurry during mixing to quaternarily pulverize the final slurry so that the macro-particles may not be generated in the final slurry.

In step ST24, the final slurry is supplied to the slurry tanks 340 and 342.

In step ST25, the final slurry is circulated between the slurry tanks 340 and 342 through the circulation line 346. Thus, the final slurry is continuously circulated without being stagnated so that the final slurry is not agglomerated within the slurry tanks 340 and 342.

In step ST26, the final slurry passes through the second filter 350 to remove the macro-particles and the foreign substances in the final slurry.

In step ST27, the densitometer 360 measures the concentration of the final slurry to determine whether the final slurry has a concentration applicable for the CMP process.

In step ST28, the final slurry having an applicable concentration for the CMP process is supplied to the CMP apparatus 600.

In step ST29, and during the above-mentioned steps ST11 to ST28, the humidified gas-supplying unit 370 continuously supplies the humidified gas to the slurry drums 310 and 312, the reproducing unit 400 and the mixing unit 500 to suppress the preliminary slurry, the reproduced slurry and the final slurry from being condensed due to a thermal exchange between the slurry and outside.

In addition, in step S30, after the final slurry is supplied to the CMP apparatus 600, the cleaning solution including KOH is provided to the system 300 for supplying slurry to clean the system 300.

Manufacturing Cyclones

Manufacturing the Cyclone in FIG. 1

The cyclone in FIG. 1 was manufactured. The cyclone included a cylindrical passageway having a diameter D1 of 9 mm and a vertical length D1 of 7.5 mm, and a conical passageway having a vertical length D2 of 69 mm.

COMPARATIVE EXAMPLE 1

A cyclone in accordance with Comparative Example 1 was manufactured. The cyclone of Comparative Example 1 included a cylindrical passageway having a diameter D1 of 9 mm and a vertical length D1 of 4.5 mm, and a conical passageway having a vertical length D2 of 22.5 mm.

COMPARATIVE EXAMPLE 2

A cyclone in accordance with Comparative Example 2 was manufactured. The cyclone of Comparative Example 2 included only a conical passageway. That is, the cyclone of Comparative Example 2 did not include a cylindrical passageway.

COMPARATIVE EXAMPLE 3

A cyclone in accordance with Comparative Example 3 was manufactured. The cyclone of Comparative Example 3 included a cylindrical passageway having a diameter D1 of 9 mm and a vertical length D1 of 2 mm, and a conical passageway having a vertical length D2 of 10 mm.

COMPARATIVE EXAMPLE 4

A cyclone in accordance with Comparative Example 4 was manufactured. The cyclone of Comparative Example 4 included a cylindrical passageway having a diameter D1 of 9 mm and a vertical length D1 of 3.75 mm, and a conical passageway having a vertical length D2 of 18.75 mm.

Testing Efficiencies for Separating Slurry of the Cyclones

Figure 12:
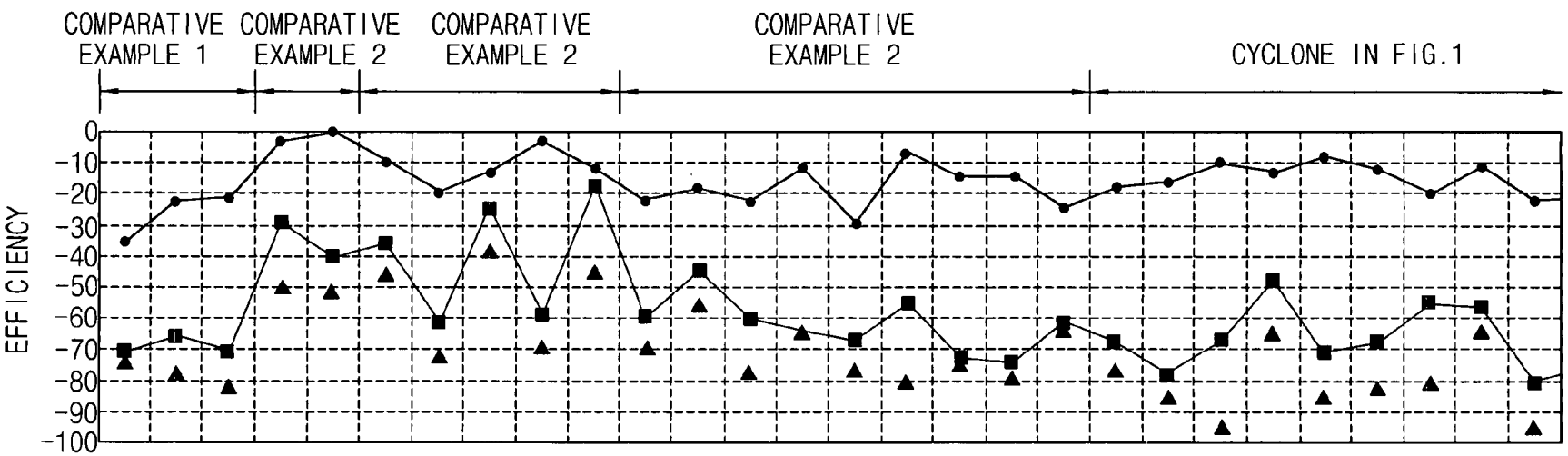
FIG. 12 is a graph illustrating separation efficiencies of the cyclone in FIG. 1 and cyclones in accordance with Comparative Examples 1 to 4.

Tests for separating slurries into first particles having a diameter of 0.98 μm, second particles having a diameter of 3.05 μm, and third particles having a diameter of 5.23 μm using the cyclone in FIG. 1, and the cyclones in accordance with Comparative Examples 1 to 4 were carried out. The test results were shown in the following Table 1 and FIG. 12. FIG. 12 is a graph illustrating separation efficiencies of the cyclone in FIG. 1 and the cyclones in accordance with Comparative Examples 1 to 4.

diameter of no less than 5 μm. Therefore, the capacities of the cyclones are determined in accordance with efficiency for separating the particles having a diameter of 5.23 μm from the slurry.

As shown in Table 1 and FIG. 12, the efficiencies for the particles having a diameter of 5.23 μm from the slurry of the cyclones in Comparative Examples 1 to 4 are no more than about 80%. However, the efficiencies for particles having a diameter of 5.23 μm from the slurry of the cyclone in FIG. 1 are no less than about 85%. Thus, it can be noted that the cyclone in FIG. 1 has a high efficiency for separating macroparticles from the slurry than those of the cyclones in Comparative Examples 1 to 4.

Testing Tolerance of Cyclones With Respect to KOH

Figure 13:
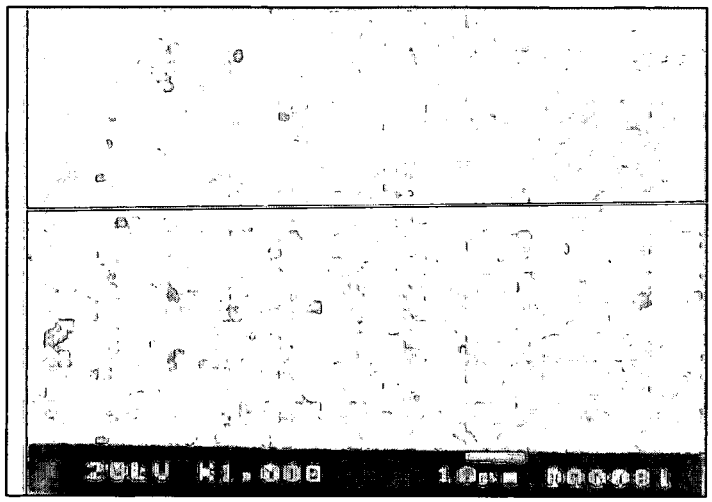
FIG. 13 is a picture illustrating an inner wall of the conventional cyclone including aluminum oxide after introduction of a KOH cleaning solution.
Figure 14:
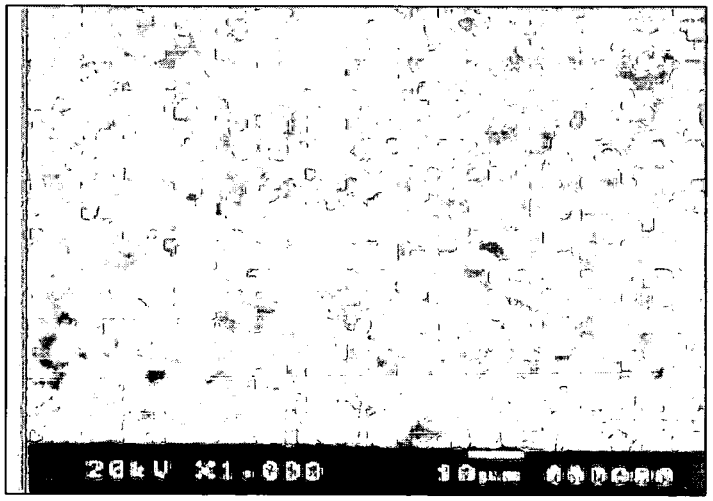
FIG. 14 is a picture illustrating an inner wall of the cyclone of FIG. 1 including silicon carbide after introduction of a KOH cleaning solution.

A KOH solution as a cleaning solution was introduced into a conventional cyclone including aluminum oxide and the cyclone including silicon carbide as in FIG. 1, respectively. Inner walls of the conventional cyclone and the cyclone in FIG. 1 were photographed using an electron microscope. FIG. 13 is a picture illustrating the inner wall of the conventional cyclone including aluminum oxide, and FIG. 14 is a picture illustrating the inner wall of the cyclone including silicon carbide in FIG. 1.

TABLE 1

| | Particle Separation Efficiencies | | | | | | | | |
|---|---|---|---|---|---|---|---|---|---|
| | Size of particle | | | | | | | | |
| | 0.98 μm | | | 3.05 μm | | | 5.23 μm | | |
| Number of particle | Inlet | Outlet | Efficiency (%) | Inlet | Outlet | Efficiency (%) | Inlet | Outlet | Efficiency (%) |
| Comparative | 4,278 | 2,784 | −35 | 641 | 187 | −71 | 277 | 71 | −74 |
| Example 1 | 6,056 | 4,742 | −22 | 412 | 139 | −66 | 187 | 41 | −78 |
| | 4,042 | 3,214 | −21 | 367 | 105 | −71 | 225 | 41 | −82 |
| Comparative | 4,333 | 4,191 | −3 | 398 | 281 | −29 | 210 | 105 | −50 |
| Example 2 | 4,484 | 4,454 | −0.7 | 303 | 181 | −40 | 151 | 73 | −52 |
| Comparative | 13,310 | 12,099 | −9 | 361 | 231 | −36 | 191 | 103 | −46 |
| Example 3 | 29,343 | 23,900 | −19 | 351 | 135 | −62 | 211 | 56 | −73 |
| | 33,587 | 29,249 | −13 | 181 | 135 | −25 | 96 | 59 | −39 |
| | 5,515 | 5,348 | −3 | 201 | 83 | −59 | 96 | 29 | −70 |
| | 6,936 | 6,072 | −12 | 196 | 162 | −17 | 120 | 66 | −45 |
| Comparative | 19,736 | 15,315 | −22 | 282 | 115 | −59 | 115 | 34 | −70 |
| Example 4 | 20,430 | 16,734 | −18 | 351 | 192 | −45 | 196 | 86 | −56 |
| | 27,185 | 21,219 | −22 | 328 | 132 | −60 | 192 | 86 | −56 |
| | 7,082 | 6,202 | −12 | 547 | 197 | −64 | 308 | 108 | −65 |
| | 8,927 | 6,303 | −29 | 324 | 108 | −67 | 164 | 37 | −77 |
| | 4,240 | 3,947 | −7 | 211 | 94 | −55 | 103 | 19 | −81 |
| | 7,135 | 6,161 | −14 | 348 | 93 | −73 | 189 | 47 | −75 |
| | 3,384 | 2,892 | −14 | 398 | 104 | −74 | 225 | 47 | −79 |
| Cyclone in FIG. 1 | 21,775 | 16,492 | −24 | 412 | 160 | −61 | 234 | 85 | −64 |
| | 13,697 | 11,196 | −18 | 385 | 126 | −67 | 225 | 51 | −77 |
| | 10,690 | 8,937 | −16 | 1,103 | 244 | −78 | 610 | 89 | −85 |
| | 5,198 | 4,657 | −10 | 145 | 70 | −67 | 94 | 19 | −95 |
| | 6,187 | 5,373 | −13 | 145 | 75 | −48 | 80 | 28 | −65 |
| | 2,719 | 2,512 | −8 | 125 | 89 | −71 | 202 | 28 | −86 |
| | 6,941 | 6,089 | −12 | 505 | 159 | −68 | 304 | 52 | −83 |
| | 4,181 | 3,332 | −20 | 211 | 94 | −55 | 117 | 23 | −80 |
| | 8,278 | 7,335 | −11 | 732 | 314 | −56 | 469 | 169 | −64 |
| | 8,470 | 6,578 | −22 | 792 | 146 | −81 | 506 | 23 | −95 |

In Table 1, the "Outlet" column corresponds to particle transmission through a first exhaust passageway of a cyclone through which the first particles having the lightest specific gravity are exhausted. Thus, the fewer the number of the exhausted particles is, the higher the efficiency of the cyclone. The second particles to be removed from the slurry have a As shown in FIG. 13, acid components of the aluminum oxide were apparently chemically reacted with alkali components in the KOH solution so that the aluminum oxide had a cut structure. Thus, when the slurry was separated, the aluminum oxide having the cut structure might be mixed with the slurry, thereby deteriorating a quality of the slurry.

In contrast, as shown in FIG. 14, the cyclone surface with silicon carbide shows very little chemical reaction with the alkali components in the KOH solution so that the silicon carbide had a firmly bonded original structure. Thus, after the slurry was separated, the quality of the slurry might be still maintained.

According to the present invention, the ratio between the vertical lengths of the cylindrical passageway and the conical passageway in the cyclone is optimally determined so that the cyclone may have improved efficiency for separating slurry.

Further, the apparatus for separating slurry has the rounded inlet passageway so that the shear stresses applied to the slurry may be considerably reduced.

Furthermore, the process for reproducing the slurry and the process for mixing the reproduced slurry with the deionized water are integrated into one system so that the system has a simple structure. In particular, since it is not needed to transport the separated slurry to the mixing unit, the macro-particles may not be generated in the slurry in transporting the slurry.

Having described the preferred embodiments of the present invention, it is noted that modifications and variations can be made by persons skilled in the art in light of the above teachings. It is therefore to be understood that changes may be made in the particular embodiment of the present invention disclosed which is within the scope and the spirit of the invention outlined by the appended claims.

What is claimed is:

1. A cyclone comprising:

a body including an inlet passageway for introducing a fluid, a cylindrical passageway that has an upper end for exhausting first particles in the fluid and a lower end, and a conical passageway that has an upper end connected to the lower end of the cylindrical passageway and an opened lower end for exhausting second particles having a specific gravity heavier than that of the first particles; and a vortex finder inserted into the upper end of the cylindrical passageway, a first exhaust passageway for exhausting the first particles, which spirally ascend from the cylindrical passageway, formed through the vortex finder in a vertical direction, wherein the cylindrical passageway has a length in the vertical direction of about 0.5 times to about 2 times a diameter of the cylindrical passageway, and the conical passageway has a length in the vertical direction of about 5 times to about 9 times the diameter of the cylindrical passageway, wherein the vortex finder further comprises a second exhaust passageway connected to the first exhaust passageway to exhaust third particles having a specific gravity heavier than that of the first particles and lighter than that of the second particles.

2. The cyclone of claim 1, wherein the second exhaust passageway is connected to the first exhaust passageway in a horizontal direction substantially perpendicular to the vertical direction.

3. An apparatus for separating slurry, comprising:

a housing including an inlet for introducing the slurry, a rounded distribution passageway connected to the inlet, a receiving space that has an upper end connected to the distribution passageway and a lower end, a first exhaust outlet for exhausting first particles in the slurry, a second exhaust outlet connected to the lower end of the receiving space to exhaust second particles in the slurry having a specific gravity heavier than that of the first particles; and a cyclone received in the receiving space to separate particles in the slurry by specific gravities, wherein the housing comprises:

a first block having the first exhaust outlet;

a second block combined with a lower face of the first block and having the inlet and the distribution passageway; and a third block combined with a lower face of the second block and having the second exhaust outlet, wherein the receiving space is formed in the first, second and third blocks in a vertical direction.

4. The apparatus of claim 3, wherein the housing further comprises a fourth block interposed between the second block and the third block.

5. The apparatus of claim 3, wherein the housing further comprises supporting plates interposed between the first and second blocks, and the second and third blocks, respectively.

6. An apparatus for separating slurry, comprising:

a housing including an inlet for introducing the slurry, a rounded distribution passageway connected to the inlet, a receiving space that has an upper end connected to the distribution passageway and a lower end, a first exhaust outlet for exhausting first particles in the slurry, a second exhaust outlet connected to the lower end of the receiving space to exhaust second particles in the slurry having a specific gravity heavier than that of the first particles; and a plurality of cyclones received in the receiving space and in communication with the rounded distribution passageway to separate particles in the slurry by specific gravities, wherein each of the cyclones comprise:

a body including an inlet passageway connected to the distribution passageway, a cylindrical passageway connected between the inlet passageway and the first exhaust outlet, and a conical passageway connected between the cylindrical passageway and the second exhaust outlet; and a vortex finder inserted into the cylindrical passageway, a first exhaust passageway formed through the vortex finder in a vertical direction and connected between the cylindrical passageway and the first exhaust outlet, wherein the vortex finder further comprises a second exhaust passageway connected to the first exhaust passageway to exhaust third particles having a specific gravity heavier than that of the first particles and lighter than that of the second particles.

7. An apparatus for separating slurry, comprising:

a housing including a first block that has a first exhaust outlet for exhausting first particles in the slurry, a second block that is combined with a lower face of the first block and has an inlet for introducing the slurry and a semicircular distribution passageway connected to the inlet, and a third block that is combined with a lower face of the second block and has a second exhaust outlet for exhausting second particles in the slurry having a specific gravity heavier than that of the first particles, wherein a receiving space connected between the distribution passageway and the second exhaust outlet is formed in the first, second and third blocks in a vertical direction; and a cyclone received in the receiving space and including a body and a vortex finder, the body including an inlet passageway that is connected to the distribution passageway, a cylindrical passageway that is connected between the inlet passageway and the first exhaust outlet, and a conical passageway that is connected between the cylindrical passageway and the second exhaust outlet, and the vortex finder inserted into the cylindrical passageway and having a first exhaust passageway that is formed through the vortex finder in the vertical direction and is connected between the cylindrical passageway and the first exhaust outlet.

8. The apparatus of claim 7, wherein the cylindrical passageway has a length in the vertical direction of about 0.5 times to about 2 times a diameter of the cylindrical passageway, and the conical passageway has a length in the vertical direction of about 5 times to about 9 times the diameter of the cylindrical passageway.

9. The apparatus of claim 7, wherein the vortex finder further comprises a second exhaust passageway connected to the first exhaust passageway to exhaust third particles having a specific gravity heavier than that of the first particles and lighter than that of the second particles.

* * * * *